US006277011B1

(12) United States Patent
Moreillon

(10) Patent No.: US 6,277,011 B1
(45) Date of Patent: Aug. 21, 2001

(54) DEBURRING, BURNISHING AND POLISHING MACHINE WITH CONVEYOR BELT DRIVE

(76) Inventor: Jean-Claude Adrien Moreillon, Im Rebberg, CH-8272 Ermatingen (CH)

( * ) Notice: Subject to any disclaimer, the term of this patent is extended or adjusted under 35 U.S.C. 154(b) by 0 days.

(21) Appl. No.: 08/558,720

(22) Filed: Nov. 16, 1995

(30) Foreign Application Priority Data

Nov. 19, 1994 (DE) ..... 44 41 273

(51) Int. Cl.[7] ..... B24B 31/00

(52) U.S. Cl. ..... 451/326; 451/328; 451/32; 451/35

(58) Field of Search ..... 451/36, 104, 106, 451/113, 326, 328, 329, 330, 32, 35

(56) References Cited

U.S. PATENT DOCUMENTS

| | | | | |
|---|---|---|---|---|
| 2,366,879 | * | 1/1945 | Skipper | 451/326 |
| 3,134,203 | | 5/1964 | Roberts | 51/164 |
| 3,246,429 | * | 4/1966 | Ruppe | 451/326 |
| 3,253,369 | * | 5/1966 | Reichert et al. | 451/326 |
| 3,315,417 | * | 4/1967 | Roberts | 451/326 |
| 3,535,159 | * | 10/1970 | Shiro | 451/36 |
| 3,680,266 | * | 8/1972 | Shiplov | 451/330 |
| 3,715,840 | * | 2/1973 | Davidson | 451/326 |
| 3,861,086 | * | 1/1975 | Dreher | 451/328 |
| 4,691,400 | * | 9/1987 | Arneson | 451/328 |
| 5,226,969 | * | 7/1993 | Watanabe et al. | 451/36 |

FOREIGN PATENT DOCUMENTS

| | | | | |
|---|---|---|---|---|
| 1934528 | | 7/1969 | (DE) . | |
| 2147476 | | 9/1971 | (DE) . | |
| 361226259 | * | 10/1986 | (JP) | 451/104 |
| 402180557 | * | 7/1990 | (JP) | 451/104 |

* cited by examiner

*Primary Examiner*—Eileen P. Morgan
(74) *Attorney, Agent, or Firm*—Brown, Martin, Haller & McClain, LLP

(57) ABSTRACT

A deburring, burnishing and polishing machine using a grinding or polishing medium rotating on an endless conveyor belt, especially for noble metals, with a service-friendly, at any time integratable collection device for the products to be polished and the polishing medium by means of a basket or a cage with holes, and with the inside of the machine being accessible at any time through a panshaped polishing trough, which on the one side is connected with the pipe frame and on the front sides exhibits a carrier profile for the storage of the conveyor rollers rotating on the backing side of the conveyor belt, whereby polishing dust or polishing solution is collected in a collection pan that can be pulled out below the polishing trough, and in the wet process the solution is transported by means of a rotating pump back into the polishing trough.

16 Claims, 5 Drawing Sheets

Fig. 3
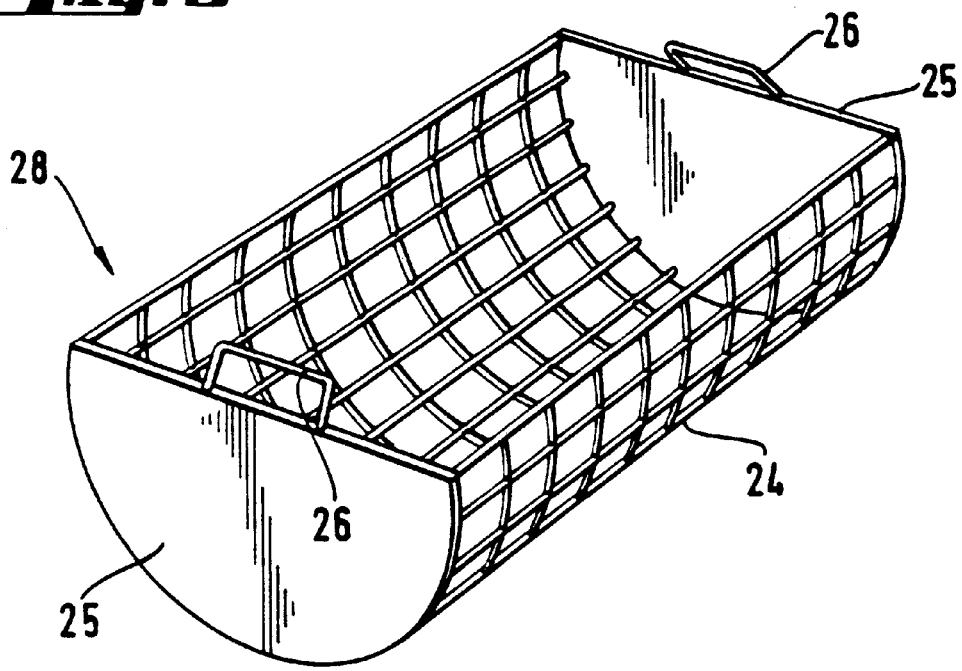
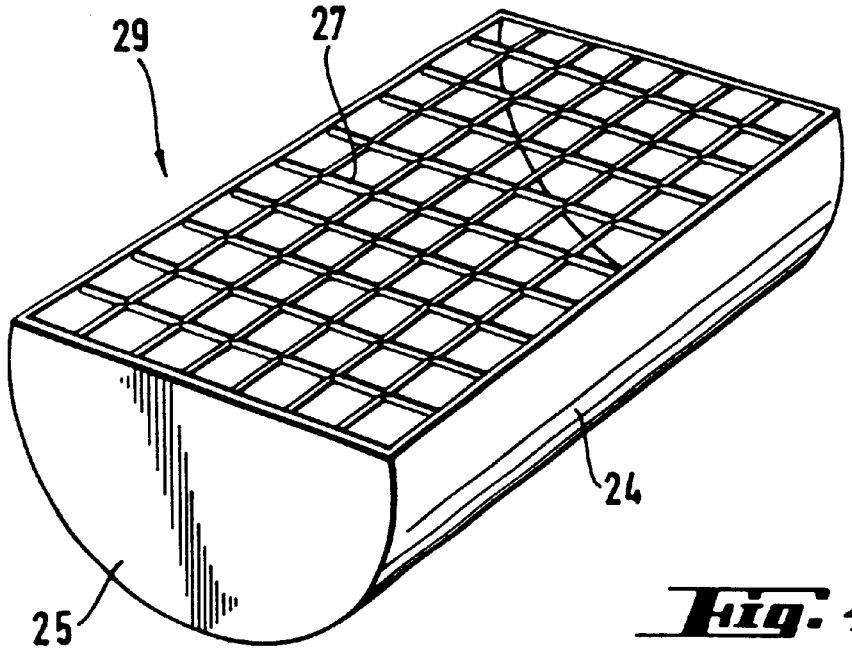
Fig. 4

DEBURRING, BURNISHING AND POLISHING MACHINE WITH CONVEYOR BELT DRIVE

BACKGROUND OF THE INVENTION

In known polishing devices with conveyor belt drive, the polishing medium is placed in rotation in a pan-shaped polishing trough by means of an endless conveyor belt. This conveyor belt slides on the round wall of the polishing trough, which in turn is located in a tightly closed water container, which simultaneously serves as the machine frame. The conveyor rollers necessary for the conveyor belt are supported outside on the water container.

This construction has on the one side the disadvantage that the products to be polished must be collected carefully by hand after the polishing process, which requires a great deal of time, especially for small parts such as cutlery or pieces of jewelry. Furthermore, when the polishing medium is changed, the polishing bodies must be removed manually from above with small buckets. On the other hand, the previous construction offers the user no access behind and below the polishing trough for periodic cleaning of the water container, where soap residues and other contamination inevitably form. Furthermore, a conveyor belt can be changed only by disassembling the polishing trough and the conveyor rollers. An equally great disadvantage of this construction is the relatively high requirement for soap solutions and their disposal.

SUMMARY OF THE INVENTION

The object of the present invention is to develop further the known polishing machine with conveyor belt drive so that these machines become substantially more operator-friendly and also more maintenance-friendly.

In order to solve this task, the invention is characterized in that a semicircular basket equipped with two handles and matched in diameter to the polishing trough has been provided in the polishing trough, which basket serves for collecting the products to be polished and/or the polishing medium.

In an additional embodiment, instead of a basket it is planned to use a semicircular cage closed on all sides and matched in diameter to the polishing trough, where the cage is used especially to separate the products to be polished from the polishing medium.

In order to make possible quick access and especially easy replacement of the conveyor belt, it is provided that the conveyor rollers rotating on the backing side of the conveyor belt are supported on a carrier profile of the stationary, pan-shaped polishing trough.

One advantage of the polishing machine according to the invention is that by using a basket or a cage after completion of the polishing process the material to be polished can be separated from the polishing medium in a simple and quick way.

Furthermore, the advantage is that the polishing medium remaining in the polishing trough can be removed quickly and simply from the polishing trough, and it is even possible to sort out the polishing medium according to the size of the bodies to be polished.

An additional advantage is that quick access to the inside of the machine and a low consumption of polishing solution is achieved.

BRIEF DESCRIPTION OF THE DRAWINGS

In the following the invention is explained in more detail by means of several drawings showing methods of execution. Additional features essential to the invention and the advantages of the invention hereby follow from the drawings and their description.

FIG. 3 shows a perspective drawing of an embodiment of the basket according to the invention for collecting the products to be polished;

FIG. 4 shows a perspective drawing of an embodiment of the cage according to the invention for separating the products to be polished or different bodies to be polished from each other;

DETAILED DESCRIPTION OF THE PREFERRED EMBODIMENTS

Figure 1:
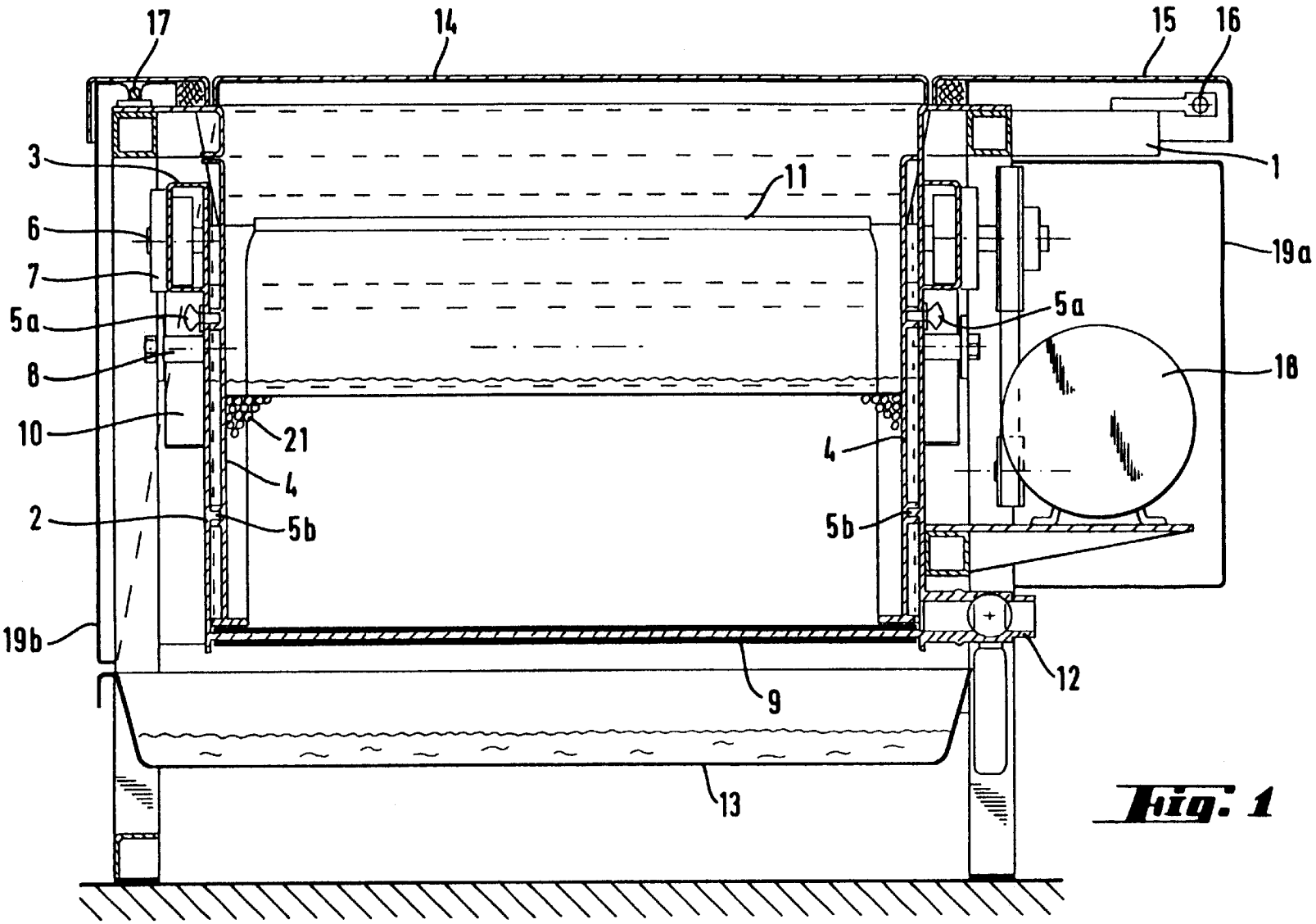
FIG. 1 shows a longitudinal representation of an embodiment of the design of the machine according to the invention with immediate access for cleaning and maintenance.

For quick removal of the products 30 being polished, a special container element (FIGS. 3 and 5) has been provided in the form of a basket 28, which is integrated into the polishing trough 2 during the polishing process or even after the polishing process has been terminated. The semicircular basket 28 with opening and two handles 26 is fitted as accurately as possible in its semicircular wall 24 to the diameter of the pan-shaped polishing trough and consists of a wire grating or a wire netting. The polishing trough contains a polishing medium which may be a liquid containing solid particles or polishing bodies 21, as illustrated in the drawings. The basket is placed in the polishing medium in the polishing trough 2 with its opening downward. Due to the rotation of the conveyor belt 9 and the polishing bodies 21, the basket 28 is pulled along so that the polishing bodies and the products to be polished 30 fall into the basket (over and over again as the case may be). After the polishing process, the machine is stopped exactly at the point in time when the handles 26 of the basket 28 point upwards. When the filled basket is lifted out, the (polishing bodies) fall through the masks of the grating, whereas the polished products 30 remain behind in the basket. The mesh size of the wire grating is in each case matched to the size of the polished products 30 in order to keep the resistance during the lifting out as low as possible.

Instead of a wire grating it is also possible to use sheet metal with holes with the largest possible openings. The front sides 25 of the basket 28 do not require any holes for this function. However, in order to keep the net weight of the basket as low as possible, it is more advantageous to provide the front side 25 as wire gratings. The handles 26 may also be placed on the semicircular wall 24. In order to reduce the force use during the lifting, several of these baskets can also be used next to each other instead of one single basket. This will especially be the case when instead of the products to be polished 30 heavy (polishing medium 21), for example, steel itself must be removed. For this purpose the holes are in each case selected to be smaller than the (polishing bodies 21), or one does without any holes at all.

Another variant for quick separation of the objects to be polished 30 from the (polishing bodies 21) is a semicircular cage 29 (FIGS. 4 and 6), which is closed on all sides and whose semicircular wall 24 is matched as accurately as possible to the diameter of the polishing trough 2 and whose flat wall 27 consists of a wire grating or a wire netting or sheet metal with holes with the largest possible openings. The semicircular wall 24 is rubberized in order to provide the greatest possible hold on the conveyor belt 9. During or after the end of the polishing process, the cage 29 with the flat wall 27 is placed in the polishing medium. Due to the rotation of the conveyor belt 29 and the polishing bodies 21, the cage 29 is also driven. The products to be polished 30 are thereby in each case pushed forward in front of the cage, while the (polishing bodies 21) fall through the mesh of the flat wall 27 into the cage. If the machine is stopped at a time when the flat wall faces upward, the products to be polished 30 lie above the polishing medium and can easily be collected. The front sides 25 as well as the semicircular wall 24 do not require any holes, but are advantageously likewise made up of wire grating in order to keep the net weight as low as possible.

Both variants, both the basket 28 with the opening as well as the cage 29, which is closed on all sides, make it possible in this way not only to separate the products to be polished 30, but they also make it possible to sort out large and small polishing solids when the mixture of the polishing medium is to be changed.

Figure 2:
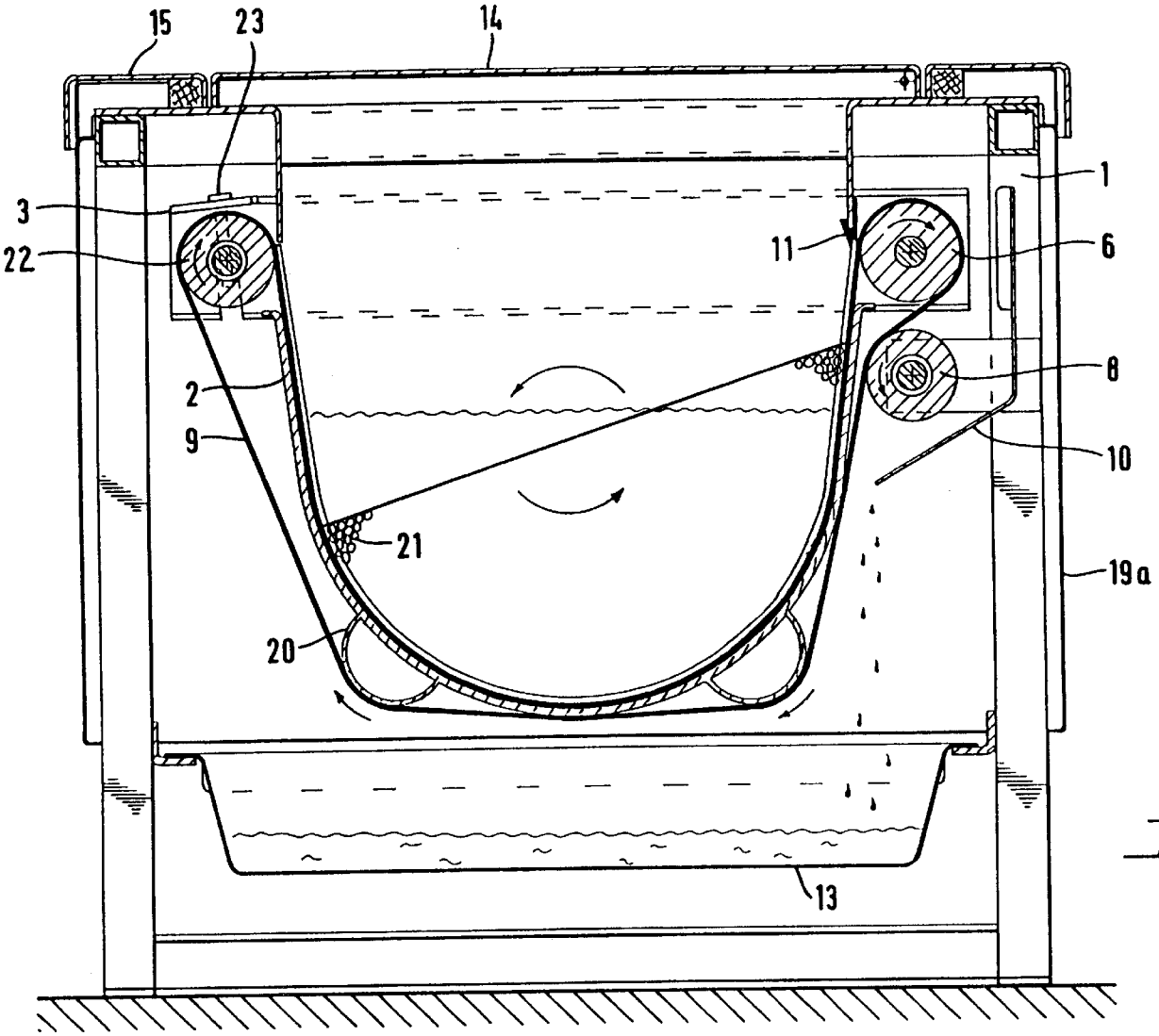
FIG. 2 shows a cross-sectional representation of the embodiment according to FIG. 1.

In order to achieve a lower consumption of (polishing medium) and rapid access to the inside of the machine, a new design has been provided, as especially FIGS. 1 and 2 show.

Instead of the "Two-Trough System" the machine now consists of only a pipe frame 1 and a chassis, in which the pan-shaped polishing trough 2 is located. This trough is screwed onto the frame at only one single front side. An endless conveyor belt 9 is driven by means of a motor 18, which acts on a drive roller 6. The conveyor belt extends around two rollers 6 and 22 and past a third roller 8. Roller 6 is the drive roller, while roller 8 is a guide roller and roller 22 is a tension roller. The rollers 6,22 rotating on the backing side of the conveyor belt 9 are supported directly on a bearing flange 7 on the polishing trough 2. For this purpose the front sides of the polishing trough exhibit a carrier profile 3 on the left and on the right sides. The conveyor belt 9 itself is subjected to the full stress only inside the polishing trough 2 between both of the upper rollers 6,22 due to the weight of the polishing bodies 21, whereas below the polishing trough it is no longer under tension. The (tension roller 22), thereby also takes over the leveling function for centering the belt, and besides the guide roller 8 the rib reinforcements 20 below the polishing trough instead of rotating rollers serve as sliding surfaces for rerouting the conveyor belt 9. Because this conveyor belt is not under tension over its entire length, the direction of rotation must be in one single direction. Leveling or tensioning screw 23, best illustrated in FIG. 2, is provided for adjusting tension in the belt 9. Adjustment of tensioning screw 23 pulls the tension roller 22 upwards and thus exerts tension on conveyor belt 9. The endless belt is rotated by the drive roller 6 and pulls the polishing bodies, which serves to apply the tension. An insertion wall 4 with a flat profile is attached to both front sides of the polishing trough by means of at least a pin 5*b* and a thumb screw 5*a* so that the conveyor bell 9 is held in position and is protected against the entry of polishing bodies between its backing side and the sliding surface of the polishing trough. Both of these insertion walls 4 can easily be removed when the conveyor belt is replaced so that the belt must only be held high and pushed lightly to the side over the polishing trough without disassembling the rollers. The tension in the new belt is generated automatically as soon as the polishing medium is filled in. In order to obtain rapid accessibility, it has been provided that the entire horizontal machine cover 14, 15, including at least one side sheeting 19*b* can be folded up by means of a hinge access 16, and the parts 14,15 and 19*b* can be held in the closed condition by means of a snap connector 17 at the frame. The side sheeting 19*a*, on the other hand, is designed as a stationary part.

A collection pan 13 for grinding dust dropping down (in the dry process) or for polishing solution dropping down (in the wet process) has been attached to the frame 1 below the polishing trough. This collection pan is advantageously manufactured in the form of a drawer that can be pulled out to make it possible to clean it at any time. For polishing purposes in the wet process, in the motor space a (small circulating pump) has been provided, which continuously transports the polishing medium that is dropping down from the collection pan back into the polishing trough. A drain cock 12 is available directly at the polishing trough for changing the liquid part of the polishing medium so that the liquid can be discharged either into the collection pan lying below for disposal or directly into the sewer system. Because only the polishing trough is filled with polishing medium, the requirement for water and polishing soap is reduced to one-sixth as compared to the customary design.

Figure 5A:
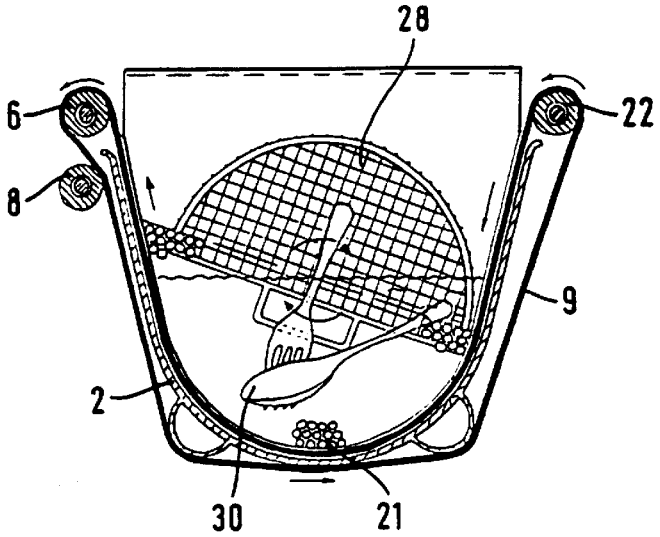
FIGS. 5A–5C show schematic representations of the principle of operation according to FIG. 3.
Figure 5B:
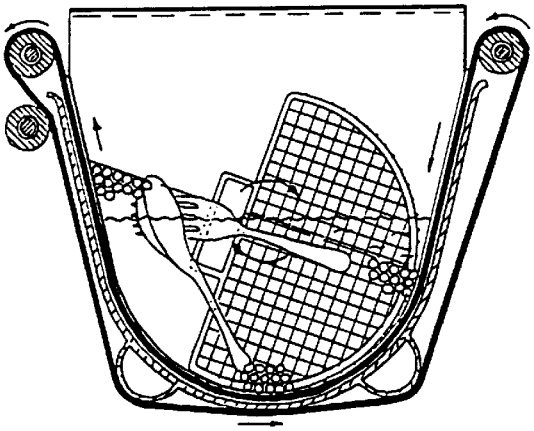
Figure 5C:
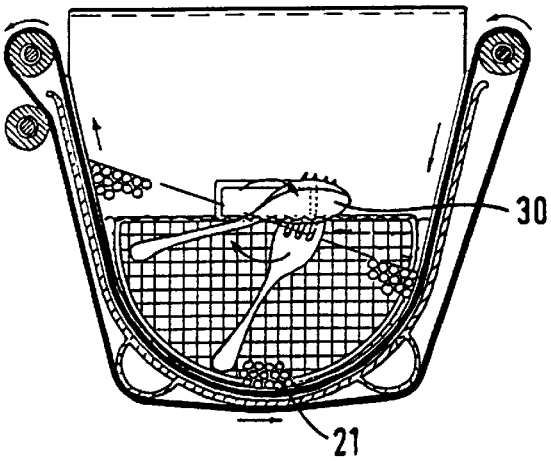

FIGS. 5A–5C show schematically the principle of operation and the mode of action of the basket 28. During the operation of the machine, the basket 28 is driven by the conveyor belt 9 and rotates inside the polishing trough 2. The products being polished are then moving inside the polishing trough 2 and are cleaned by the polishing medium (FIGS. 5A and 5B). If the machine is stopped at the point at which the basket 28 is located in the upright position (FIG. 5C), then the basket 28 with the products being polished 30 collected in it can be removed. When the basket is taken out, the polishing bodies 21 fall through the gratings and remain behind in the polishing trough 2.

Figure 6A:
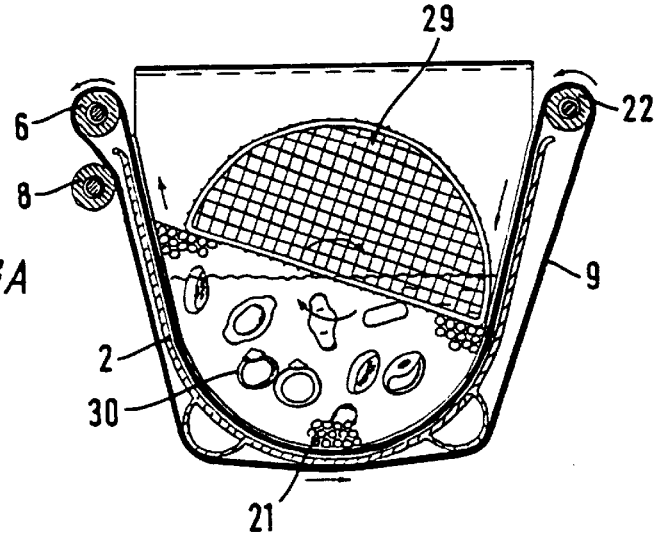
FIGS. 6A–6C show schematic representations of the principle of operation according to FIG. 4.
Figure 6B:
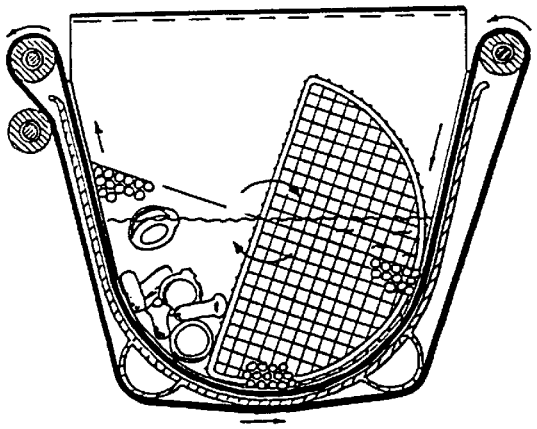
Figure 6C:
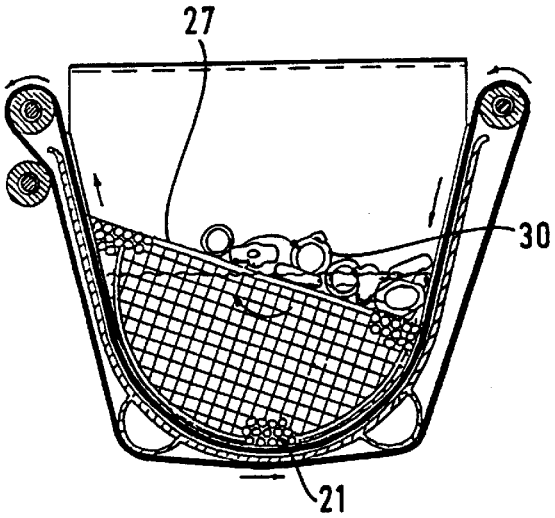

FIGS. 6A–6C show schematically the principle of operation and the mode of action of the cage 29. During the operation of the machine, the cage 29 is driven by the conveyor belt 9 and rotates inside the polishing trough 2. The products being polished 30 then move inside the polishing trough 2 and are cleared by the polishing medium (FIGS. 6A and 6B). If the machine is stopped at the point at which the cage 28 is located approximately in the upright position (FIG. 6C), then the cage 29 can be removed with the products being polished 30 collected on its flat wall 27. When the cage 29 is taken out, the polishing bodies 21 drop through its gratings and remain behind in the polishing trough 2. If the mesh size of the basket or the cage is selected smaller than the size of the polishing bodies, then the polishing bodies can also be taken out of the polishing trough in the same way as described above in connection with the products being polished.

Although some preferred embodiments of the invention have been described above by way of example only, it will be understood by those skilled in the field that modifications may be made to the disclosed embodiments without departing from the scope of the invention, which is defined by the appended claims.

I claim:

1. A machine for deburring, burnishing and polishing metal products to be polished, comprising:

a frame;

a stationary, pan-shaped polishing trough mounted in the frame, the polishing trough having a diameter;

the polishing trough containing a polishing medium;

an endless conveyor belt;

a drive motor attached to the frame;

at least two rollers rotatably mounted on the frame, one of said rollers comprising a drive roller driven by said drive motor and the other roller comprising a tension roller;

an endless conveyor belt extending over said rollers and through said polishing trough; and a semicircular basket movably fitting into said polishing trough, whereby movement of said conveyor belt moves said basket relative to said trough, said basket having two handles and having a diameter substantially matching the diameter of said polishing trough, and comprising means for collecting products being polished.

2. Machine according to claim 1, characterized in that the basket consists of a wire grating or a wire netting.

3. Machine according to claim 1, characterized in that the basket exhibits a semicircular wall.

4. Machine according to claim 1, including a carrier profile attached to the stationary, pan-shaped polishing trough, the drive roller and the tension roller being supported on said carrier profile.

5. Machine according to claim 1, characterized in that the polishing trough on the bottom side exhibits rounded rib reinforcements, which simultaneously serve as stationary glide surface for the rotating conveyor belt.

6. Machine according to claim 1, characterized in that under the polishing trough a removable collection pan has been provided, the collection pan comprising of a drawer for collecting grinding dust falling down or polishing medium dripping down.

7. Machine according to claim 1, characterized in that the frame has an upper machine cover, a lid and at least a side sheeting, which can be raised up by means of a hinge for changing the conveyor belt.

8. The machine as claimed in claim 1, including a third roller comprising a guide roller for guiding said belt.

9. A machine for deburring, burnishing and polishing metal goods, especially of noble metals, comprising:

a frame;

a stationary, pan-shaped polishing trough mounted in the frame for holding a polishing medium, the polishing trough having a diameter;

a drive motor attached to the frame;

at least three rollers rotatably mounted on the frame, comprising a drive roller driven by the motor, a guide roller, and a tension roller;

an endless conveyor belt extending over said drive roller and tension roller and through said polishing trough; and a semicircular cage for removably fitting into the polishing trough and having a diameter substantially matching the diameter of the polishing trough, the cage being closed on all sides, whereby movement of the conveyor belt moves the cage relative to the polishing trough and displaces metal goods in the polishing medium as it moves, the cage comprising means for displacing metal products to be polished during a polishing process and means for separating polished products from the polishing medium when the polishing process is finished.

10. Machine according to claim 9, wherein the basket exhibits a semicircular wall, two end walls, and an upper wall enclosing the basket interior, whereby the semicircular wall and the end walls do not exhibit any holes and the upper wall has holes.

11. Machine according to claim 9, characterized in that the cage consists of a wire grating or a wire netting.

12. Machine according to claim 9, characterized in that the cage exhibits a flat wall.

13. Machine according to claim 9, characterized in that the drive roller rotating on the backing side of the conveyor belt and the conveyor roller are each supported on a carrier profile, which is attached to the stationary, pan-shaped polishing trough.

14. Machine according to claim 9, wherein the polishing trough has a bottom side exhibits rounded rib reinforcements, which simultaneously serve as stationary sliding surface for the rotating conveyor belt.

15. Machine according to claim 9, characterized in that below the polishing trough a removable collection pan has been provided, the pan comprising a drawer which serves for collecting grinding dust falling down or polishing medium dripping down.

16. Machine according to claim 9, characterized in that the frame has an upper machine cover, a lid and at least a side sheeting, which can be folded upward by means of a hinge for changing the conveyor belt.

* * * * *